US008746143B2

(12) United States Patent
Berti et al.

(10) Patent No.: US 8,746,143 B2
(45) Date of Patent: Jun. 10, 2014

(54) METHOD AND APPARATUS FOR COMPENSATING FOR INKING DIFFERENCES IN PRINTING PRESSES WITH AN ANILOX SHORT INKING UNIT AND PRINTING PRESS HAVING THE APPARATUS

(75) Inventors: Christopher Berti, Dielheim (DE); Manfred Jurkewitz, Wiesloch (DE); Jürgen Rautert, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 309 days.

(21) Appl. No.: 12/909,038

(22) Filed: Oct. 21, 2010

(65) Prior Publication Data

US 2011/0088577 A1 Apr. 21, 2011

(30) Foreign Application Priority Data

Oct. 21, 2009 (DE) ..... 10 2009 050 027

(51) Int. Cl.
*B41F 1/54* (2006.01)
*B41F 23/04* (2006.01)
*B41F 33/00* (2006.01)

(52) U.S. Cl.
CPC ..... *B41F 33/0045* (2013.01); *B41F 33/0063* (2013.01); *Y10S 101/45* (2013.01)
USPC ..... 101/484; 101/487; 101/DIG. 45

(58) Field of Classification Search
CPC ..... B41F 33/0036; B41F 33/0045; B41F 33/0054; B41F 33/0063; B41F 13/22
USPC ..... 101/211, 484, 487, DIG. 45
See application file for complete search history.

(56) References Cited

U.S. PATENT DOCUMENTS

| | | | | |
|---|---|---|---|---|
| 5,546,861 | A | 8/1996 | Loffler | |
| 7,004,070 | B2 | 2/2006 | Schneider et al. | |
| 7,262,880 | B2 | 8/2007 | Geissler et al. | |
| 7,389,728 | B2 | 6/2008 | Hieronymus et al. | |
| 7,421,948 | B2 | 9/2008 | Schneider et al. | |
| 7,464,645 | B2 | 12/2008 | Jeschonneck et al. | |
| 7,523,706 | B2 | 4/2009 | Schneider et al. | |
| 8,127,672 | B2 * | 3/2012 | Muller et al. | 101/216 |

(Continued)

FOREIGN PATENT DOCUMENTS

| | | |
|---|---|---|
| CN | 101090821 A | 12/2007 |
| CN | 101096138 A | 1/2008 |

(Continued)

OTHER PUBLICATIONS

German Search Report dated Jun. 14, 2010.

*Primary Examiner* — Ren Yan
(74) *Attorney, Agent, or Firm* — Laurence A. Greenberg; Werner H. Stemer; Ralph E. Locher

(57) ABSTRACT

A method and an apparatus for compensating for inking differences between setpoint color values and actual color values in offset printing presses having at least one inking unit and a control computer. The control computer controls the printing speed of the offset printing press and the temperature control of rollers in the inking unit of the offset printing press. The control computer is set up in such a way that, if an inking difference is detected between the setpoint color values and the actual color values, a combined control operation including a change in the printing speed and the temperature in the inking unit is performed in order to compensate for the inking difference. A printing press having the apparatus is also provided.

4 Claims, 4 Drawing Sheets

(56) References Cited

U.S. PATENT DOCUMENTS

| | | | | |
|---|---|---|---|---|
| 2005/0274273 | A1 * | 12/2005 | Schneider et al. | 101/487 |
| 2008/0000371 | A1 | 1/2008 | Okada et al. | |
| 2008/0017061 | A1 | 1/2008 | Muller et al. | |
| 2008/0041258 | A1 * | 2/2008 | Schneider et al. | 101/487 |

FOREIGN PATENT DOCUMENTS

| | | | |
|---|---|---|---|
| CN | 101130296 | A | 2/2008 |
| DE | 3904854 | C1 | 4/1990 |
| DE | 4413731 | A1 | 10/1995 |
| DE | 19736339 | B4 | 3/2004 |
| DE | 10254501 | A1 | 5/2004 |
| DE | 102004044215 | A1 | 12/2005 |
| DE | 102005005303 | A1 | 7/2006 |
| DE | 102006061341 | A1 | 6/2008 |
| DE | 102008001309 | A1 | 8/2009 |
| JP | 62227749 | A | 10/1987 |
| WO | WO 2009100783 | A2 * | 8/2009 |

* cited by examiner

METHOD AND APPARATUS FOR COMPENSATING FOR INKING DIFFERENCES IN PRINTING PRESSES WITH AN ANILOX SHORT INKING UNIT AND PRINTING PRESS HAVING THE APPARATUS

CROSS-REFERENCE TO RELATED APPLICATION

This application claims the priority, under 35 U.S.C. §119, of German Patent Application DE 10 2009 050 027.8, filed Oct. 21, 2009; the prior application is herewith incorporated by reference in its entirety.

BACKGROUND OF THE INVENTION

Field of the Invention

The present invention relates to a method and an apparatus for compensating for inking differences between setpoint color values and actual color values in printing presses having at least one inking unit and a control computer. The invention also relates to a printing press having the apparatus.

In offset printing presses having zoneless short inking units, also called anilox inking units, there is the problem that, in contrast to zonal inking units, the ink metering over the entire width of the printing material cannot be regulated individually in different zones. That makes precise ink metering difficult, but such precise ink metering is required in order to ensure that measured actual color values on produced printing materials do not differ too much from setpoint color values of the printing original. An inking difference of that type which exists has to be compensated for as quickly as possible, since printing materials with deviating color values have to be rejected as waste due to insufficient coloring and cannot be sold.

German Patent DE 197 36 339 B4 has disclosed the use of a zoneless short inking unit for regulating the ink quantity in a printing unit. In that case, the dependencies between ink quantity and temperature which are stored in the printing press as control characteristic curves are used for metering. In that way, the ink quantity can be metered by corresponding setting of the temperature in the inking unit of the offset printing press, and the coloring of the printing materials can thus be influenced.

Furthermore, German Patent DE 39 04 854 C1 has disclosed that the printing speed likewise has effects on the inking of the cylinders in the printing press.

German Published, Non-Prosecuted Patent Application DE 10 2004 044 215 A1, corresponding to U.S. Pat. Nos. 7,421,948 and 7,523,706 as well as U.S. Patent Application Publication No. US 2008/0017061, discloses a method, by way of which color changes which are associated with a change in the printing speed in the printing press and have a negative effect on the printing quality can be compensated for by a change in the temperature of the printing ink. A method is thus provided, by way of which the inking is kept constant by temperature control even in the case of a changing printing speed, by changes in the coloring as a result of both effects counteracting one another. However, there is no indication from those documents as to how determined inking differences between setpoint color values and actual color values can be compensated for, that is to say if a targeted change in the inking has to be carried out in order to adapt the measured actual color values to the setpoint color values of the printing original.

SUMMARY OF THE INVENTION

It is accordingly an object of the invention to provide a method and an apparatus for compensating for inking differences between setpoint color values and actual color values in printing presses having zoneless anilox inking units and a control computer, as well as a printing press having the apparatus, which overcome the hereinafore-mentioned disadvantages of the heretofore-known methods and apparatuses of this general type and which make quick and efficient compensation of inking differences between setpoint color values and actual color values possible.

With the foregoing and other objects in view there is provided, in accordance with the invention, a method for compensating for inking differences between setpoint color values and actual color values in printing presses having at least one inking unit and a control computer. The method comprises performing a combined control operation including a change in printing speed and a change in temperature in the at least one inking unit, with the control computer, in order to compensate for an inking difference detected between setpoint color values and actual color values.

With the objects of the invention in view, there is also provided an apparatus for compensating for inking differences between setpoint color values and actual color values in offset printing presses having at least one inking unit with rollers. The apparatus comprises a control computer controlling a printing speed of the offset printing press and a temperature control of the rollers in the at least one inking unit of the offset printing press. The control computer is configured or programmed to perform a combined control operation including a change in the printing speed and a change in the temperature in the at least one inking unit to compensate for an inking difference detected between the setpoint color values and the actual color values.

In principle, the method according to the invention and the apparatus according to the invention can be used in all offset printing presses, but are suitable, in particular, for use in offset printing presses having anilox short inking units. In order to compensate for inking differences between setpoint color values and actual color values quickly and efficiently, there is a provision according to the invention for a combined control operation to take place, in which firstly the printing speed is changed and secondly the temperature in the inking unit is changed. Since a change in the printing speed has a much quicker effect on the coloring, first of all an inking difference can be compensated for quickly by a speed change. However, this has the disadvantage in principle that the printing speed changes as a result, which leads, in particular, in the case of a reduction in the printing speed, to a reduced production output of the printing press. The present invention therefore provides for the temperature in the inking unit to be changed at the same time as or subsequently to the change in the printing speed, with the result that the printing speed can be directed slowly again to the initial speed or at least to an approximation of the initial speed before the compensation of the inking difference. It is possible in this way, as a result of a combined control operation, to use the advantages of the quick inking change by a change in the printing speed, without accepting the disadvantages of a permanently changed printing speed, since the machine can be returned again to the initial speed by a change in the temperature in the inking unit.

In accordance with another feature of the invention, a time period during the change in the printing speed is substantially shorter than a time period during the change in the temperature in the inking unit. Since a change in the printing speed brings about an inking change much more quickly, while a temperature change only brings about a slow change in the inking, a brief change in the printing speed is sufficient to achieve quick compensation of the inking difference. In contrast, a comparatively long heating or cooling operation is necessary for the temperature change.

In accordance with a further feature of the invention, as soon as the temperature change brings about a change in the inking difference between setpoint color values and actual color values, the printing speed is returned by the control computer to the original printing speed before the start of the control operation again. This leads to the printing press again running at the same speed at the end of the combined control operation as at the start of the control operation, with the result that, at the end, the inking difference has been compensated for exclusively through the temperature.

In accordance with an added feature of the invention, the return of the printing speed to the initial speed before the control operation takes place temporally parallel to the temperature change in the inking unit. Since a temperature change in the inking unit only brings about a slow change in the inking difference in the inking unit of an offset printing press, it is appropriate, in order to save time, to carry out the temperature change at the same time as the change in the printing speed. As soon as the temperature change then begins to act in the inking unit, the printing speed can be returned again in steps or steadily according to the temperature change, to the original printing speed before the control operation.

In accordance with an additional feature of the invention, the range of the inking difference which can be compensated for is enlarged through simultaneous adjustment of temperature and printing speed. In this variant, the printing speed is not returned to the initial speed, with the result that both inking changes continue to exist in parallel as a result of temperature changes and printing speed changes. In this way, the range of the inking difference which can be compensated for can be enlarged in comparison with the use of only one method.

In accordance with yet another feature of the invention, the temperature of at least one roller is changed in order to change the temperature in the inking unit. In this case, either engraved rollers or ink applicator rollers can have their temperature controlled, and it goes without saying that both roller types and further rollers in the inking unit can also have their temperature controlled. However, this leads to a technically more complicated construction, since the rollers which can have their temperature controlled have to be connected to a corresponding temperature control device. Such temperature control devices expediently have a liquid circuit with a heating and/or cooling device which is connected to the control computer of the printing press. The rollers are then either heated or cooled by the control computer as a function of overinking or underinking through the temperature control device, with the result that desired temperature changes with correspondingly desired signs are performed.

Instead of a liquid circuit, it goes without saying that other temperature control elements such as electrically actuated Peltier elements can also be used directly on the rollers. This has the advantage that merely electric connections for the rollers are required in this case, which is less complicated in structural terms in comparison with a liquid circuit with corresponding seals in the roller passage. In order to improve the heating or cooling action, it is recommended to use rollers with a particularly large surface area because in this way a particularly large amount of heat or cooling action can be transferred to the printing ink on the rollers.

With the objects of the invention in view, there is concomitantly provided a printing press which is equipped according to the invention to have a plurality of printing units with temperature control devices, and for it to be possible for individual rollers of the inking units to have their temperatures controlled individually in the printing units. In this way, the inking of the desired printing ink can be set in each inking unit in a targeted manner, with the result that compensation of the inking difference between setpoint color values and actual color values is possible which is as exact as possible. It is possible in this case to perform the combined control operation at the same time in every inking unit, but it is also possible to carry out the combined control operation in every inking unit separately and, for example, one after another in a targeted manner. This is also dependent on in which inking units an inking difference has to be compensated for. The more printing inks that have an inking difference, the more quickly the regulating operation takes place if the inking differences are compensated for at the same time in all of the inking units. In this case, the simultaneous use of the combined control operation including a change in the printing speed and in the temperature in all of the inking units is preferred.

Other features which are considered as characteristic for the invention are set forth in the appended claims.

Although the invention is illustrated and described herein as embodied in a method and an apparatus for compensating for inking differences in printing presses with an anilox short inking unit and a printing press having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
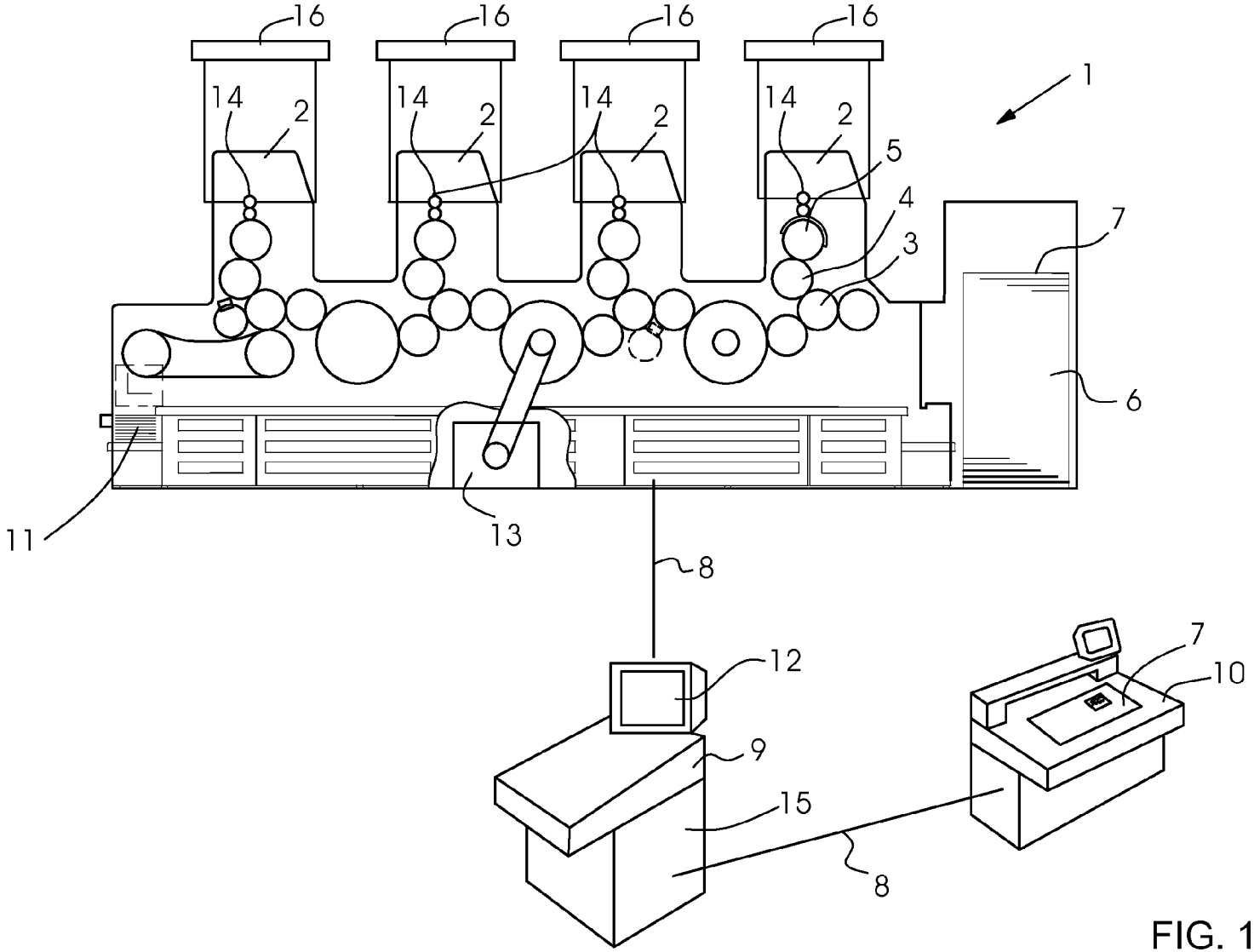
FIG. 1 includes a diagrammatic, longitudinal-sectional view of a four color anilox sheet-fed offset printing press and a perspective view of a control computer.

Referring now to the figures of the drawings, it is noted that the present invention is suitable, in particular, for controlling inking in zoneless offset printing presses with anilox short inking units. Such anilox short inking units are used both in sheet-fed offset printing presses and in web-fed rotary printing presses, in particular in the newspaper field. FIG. 1 shows by way of example a four color anilox sheet-fed offset printing press 1 which has four printing units 2. In principle, all of the printing units 2 are of identical construction, as a result of which each printing unit 2 has a plate cylinder 5 with a printing plate of a respective color separation, a blanket cylinder 4 for transferring ink from the plate cylinder onto printing material 7 and an impression cylinder 3 which forms a press nip together with the blanket cylinder 4. Each printing unit 2 likewise has an inking unit 14 which is configured as an anilox short inking unit. The inking units 14 therefore substantially include engraved rollers and ink applicator rollers. In addition, each printing unit 2 has a temperature control circuit 16, by way of which the temperature of the printing ink can be set separately in each inking unit 14.

The temperature control circuits 16 are connected to a control computer 15, like all other electrically adjustable machine components. All of the printing units 2 are interconnected through a non-illustrated mechanical gearwheel train and are driven by a common drive motor 13. The sheet-shaped printing materials 7 are removed from a feeder 6 and are fed to the first printing unit of the sheet-fed printing press 1. After the sheets 7 have been printed in the four printing units 2 successively with the four color separations black, cyan, magenta and yellow, the finished sheets 7 are deposited in a delivery 11. In addition to the printing press 1, the control computer 15 is also connected to a color measuring instrument 10 through a communications link 8. Sample sheets 7 which are removed from the delivery 11 are deposited on the color measuring instrument 10 and are measured colorimetrically. Actual color values determined in this way are transmitted through the communications link 8 to the control computer 15 and are compared with setpoint color values of a printing original from a prepress stage. If the control computer 15 determines impermissible deviations between actual color values and setpoint color values, there is an inking difference which has to be compensated for. To this end, the control computer 15 calculates a temperature change required for each inking unit 14 and a required speed change, in order for it to be possible to compensate for the determined inking differences as quickly as possible.

In order to carry out the speed change, the control computer 15 emits a corresponding control signal through the communications link 8 to the drive motor 13 of the sheet-fed offset printing press 1. Since the sheet-fed offset printing press 1 has only one drive motor 13, the inking can only be changed through a speed change in all of the printing units 2 at the same time. The scope is greater in the case of the temperature change, since each printing unit 2 has a dedicated temperature circuit 16 in this case which can be actuated individually by the control computer 15. Each anilox inking unit 14 can therefore have its temperature controlled separately. The printing press 1 is operated through a display screen 12 which is configured as a touchscreen and is connected in turn to the control computer 15. The operator of the printing press 1 can also perform inking changes manually if this is desired through the touchscreen 12 which is disposed on an operating desk 9.

Figure 2:
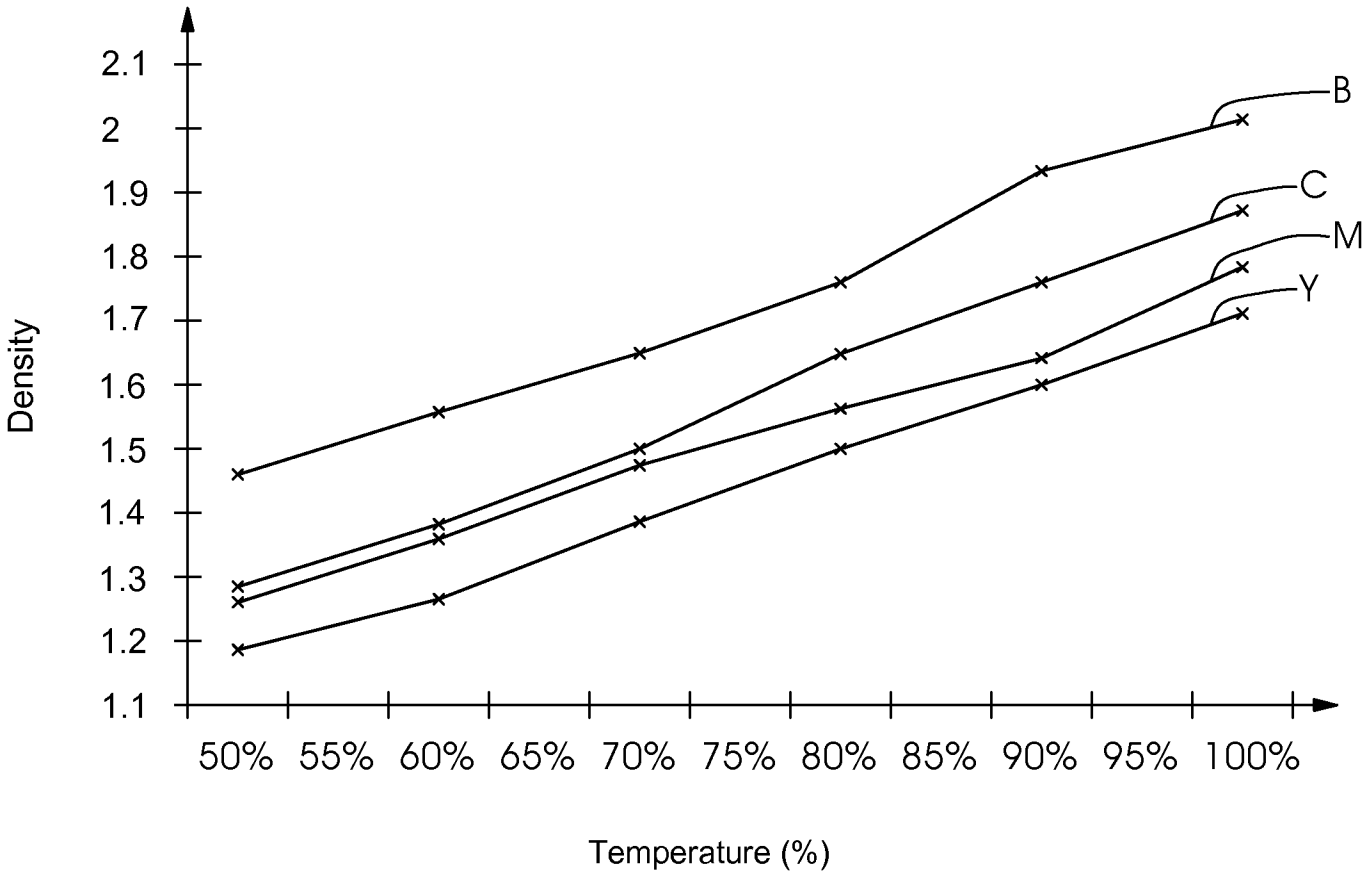
FIG. 2 is a graph showing an ink density profile of the four printing colors black, cyan, magenta and yellow as a function of temperature.

FIG. 2 shows, by way of example, ink density profiles of the four process colors black B, cyan C, magenta M and yellow Y as a function of the temperature in the anilox inking unit 14. It can be seen that relatively great temperature changes are necessary for relatively small density changes in order to change the inking. These temperature changes need a comparatively long amount of time due to the sluggish reaction of the system.

Figure 3:
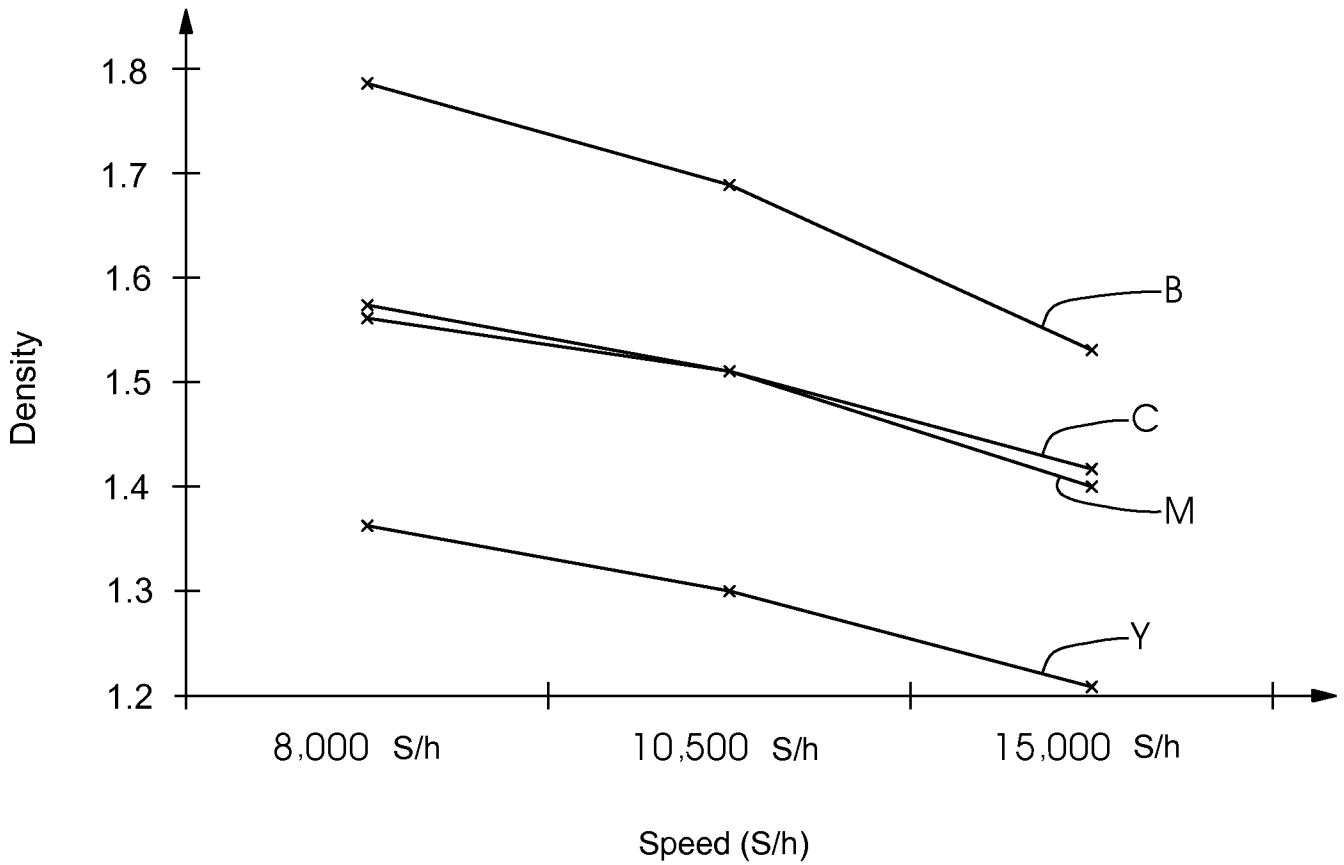
FIG. 3 is a graph showing the ink density profile of the printing colors black, cyan, magenta and yellow as a function of printing speed.

In contrast to this, FIG. 3 shows the dependency of the density profiles of the four process colors black B, cyan C, magenta M and yellow Y as a function of the printing speed in sheets per hour. Since the printing speed can be changed quickly by actuation of the drive motor 13, inking changes can be carried out much more quickly through the change in the printing speed than inking changes as a result of a change in the temperature.

Figure 4:
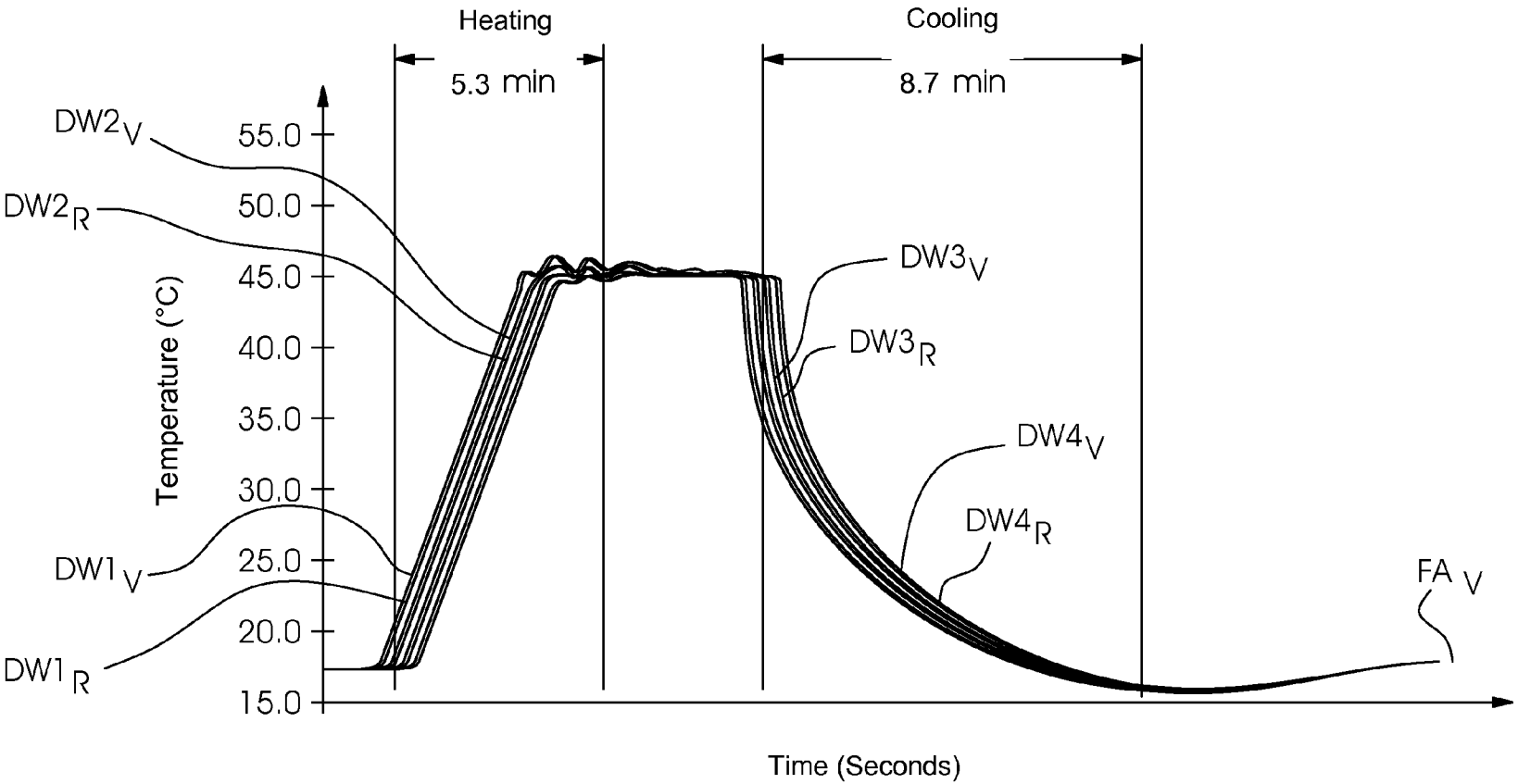
FIG. 4 is a graph showing one example of a change in the inking in all four printing units as a result of a simultaneous temperature change in all engraved rollers.

FIG. 4 shows, by way of example, temperature changes of the engraved rollers in the four anilox inking units 14 for the colors black B, cyan C, magenta M and yellow Y, which temperature changes are necessary to change the inking. It can be seen that first of all, all of the engraved rollers are heated at the same time from 17 to 45 degrees over a time of 5.3 minutes, then the temperature is kept constant for a time, which is then in turn followed by a cooling phase over 8.7 minutes. It can be seen that the entire operation takes a very long time in comparison with a speed change. In this case, temperature profiles are illustrated for each printing unit at the inlet of the engraved roller and at the outlet of the engraved roller. In addition, the temperature at the inlet of the ink applicator rollers is illustrated.

The reference symbols used in FIG. 4 have the following meanings:

$DW1_V$ Inlet, engraved roll, 1st printing unit
$DW1_R$ Outlet, engraved roll, 1st printing unit
$DW2_V$ Inlet, engraved roll, 2nd printing unit
$DW2_R$ Outlet, engraved roll, 2nd printing unit
$DW3_V$ Inlet, engraved roll, 3rd printing unit
$DW3_R$ Outlet, engraved roll, 3rd printing unit
$DW4_V$ Inlet, engraved roll, 4th printing unit
$DW4_R$ Outlet, engraved roll, 4th printing unit
$FA_V$ Inlet, ink applicator rolls In the method according to the invention, the control computer 15 additionally superimposes the speed change of the printing speed onto the temperature curves shown in FIG. 4, with the result that the inking changes are carried out relatively quickly and nevertheless the initial printing speed can be reached again at the end of the regulating operation, by ultimately compensating for the inking difference through the change in the temperature in the anilox inking units 14.

The invention claimed is:

1. A method for compensating for inking differences between setpoint color values and actual color values in printing presses having at least one inking unit and a control computer, the method comprising the following steps:

performing a combined control operation including a change in printing speed and a simultaneous change in temperature in the at least one inking unit, with the control computer, in order to compensate for an inking difference detected between setpoint color values and actual color values; and returning the printing speed again to an original printing speed before a start of the control operation, with the control computer, as soon as the temperature change brings about a change in the inking difference between the setpoint color values and the actual color values.

2. The method according to claim 1, which further comprises setting a time period during the change in the printing speed to be substantially shorter than a time period during the change in the temperature in the at least one inking unit.

3. The method according to claim 1, which further comprises carrying out a return of the printing speed to an initial speed, before the control operation takes place, temporally parallel to the temperature change in the inking unit.

4. The method according to claim 1, which further comprises enlarging a range of the inking difference to be compensated for through simultaneous adjustment of temperature and printing speed.

* * * * *